United States Patent [19]

Grevich et al.

[11] 4,240,336

[45] Dec. 23, 1980

[54] BAG MAKING MACHINE

[75] Inventors: John J. Grevich, Star Prairie; Stanley D. Denker, New Richmond, both of Wis.

[73] Assignee: Nordson Corporation, Amherst, Ohio

[21] Appl. No.: 924,133

[22] Filed: Jul. 13, 1978

[51] Int. Cl.[3] ..... B31B 1/16

[52] U.S. Cl. ..... 493/196; 83/346; 493/201; 271/225

[58] Field of Search ..... 93/33 R, 33 H; 271/225; 83/337, 346, 347

[56] References Cited

U.S. PATENT DOCUMENTS

| | | | |
|---|---|---|---|
| 1,015,836 | 1/1912 | Read | 83/346 X |
| 2,278,518 | 4/1942 | Kenney et al. | 271/225 X |
| 2,668,708 | 2/1954 | Back | 271/225 |
| 3,192,096 | 6/1965 | Rhine | 156/513 |
| 3,401,930 | 9/1968 | Bishop | 271/225 |
| 4,014,539 | 3/1977 | Goodwin | 271/225 X |
| 4,080,241 | 3/1978 | Grevich et al. | 156/498 |
| 4,151,699 | 5/1979 | Focke et al. | 83/346 X |

FOREIGN PATENT DOCUMENTS

| | | | |
|---|---|---|---|
| 454751 | 2/1949 | Canada | 83/347 |

*Primary Examiner*—Robert D. Baldwin
*Attorney, Agent, or Firm*—H. Dale Palmatier

[57] ABSTRACT

A bag making machine continuously drawing and propelling tube stock from a supply in a roll, including an in-feed conveying mechanism having feed rolls drawing the tube stock from the supply, a horizontal belt conveyor with spaced individual belts carrying the tube stock in horizontally laid out condition, a continuously moving cutter mechanism including clamping jaws above and below the tube stock on the belt conveyor, the lower jaw having slots receiving the belts therein, the upper and lower jaws having stationary and yieldable jaws to grip, clamp and stretch the film, and the upper jaw having a cutter moving downwardly in a slot into a corresponding slot in the lower jaw; a crimper to longitudinally corrugate the tube segments severed from the tube stock and shoot the severed tube segments across the receiving end of a crossfeed conveyor mechanism which changes the direction of the tube segments, the crossfeed conveyor mechanism including a roller conveyor to receive and carry the tube segments transversely from their first direction of movement, weighted balls aligned along adjacent ends of the rollers in the roller conveyor; a moving fence against which the edges of the bags engage at the crossfeed conveyor, the crossfeed conveyor mechanism also having a belt conveyor with spinning balls superposed above belts at the edges of the tube stock and guiding the tube stock into a high speed sealer along one side of the belt conveyor, and the belt conveyor supplying the bags formed from the tube stock into superposed upper and lower stacking conveyors alternately directing a number of bags onto accumulating conveyors.

17 Claims, 13 Drawing Figures

FIG. 2
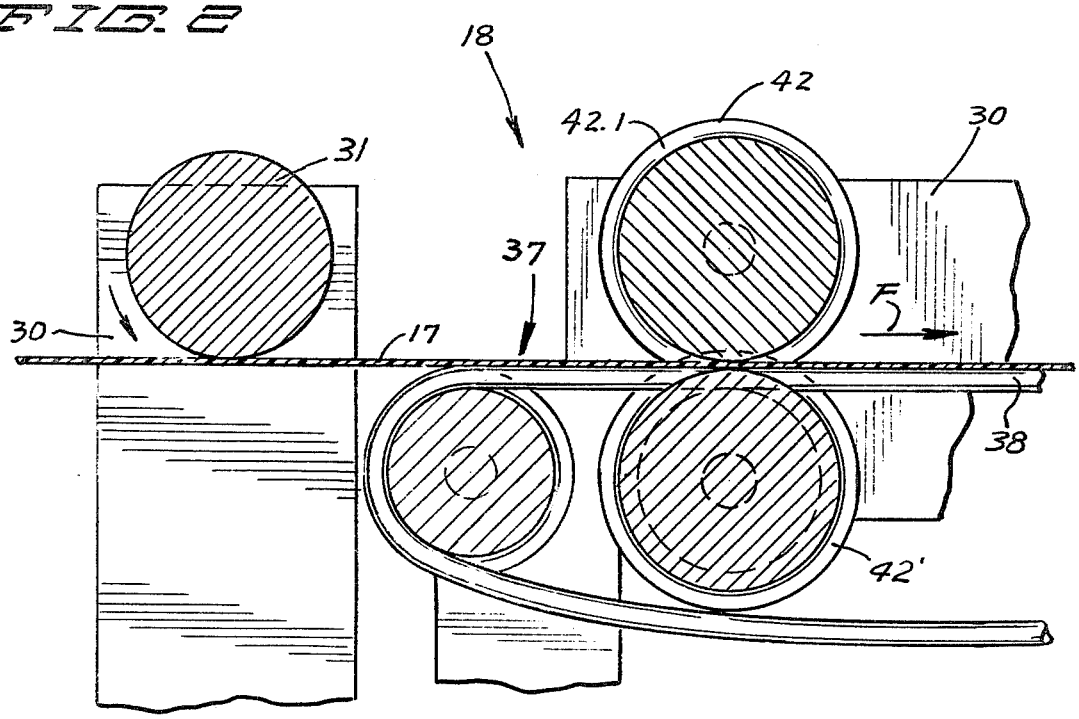
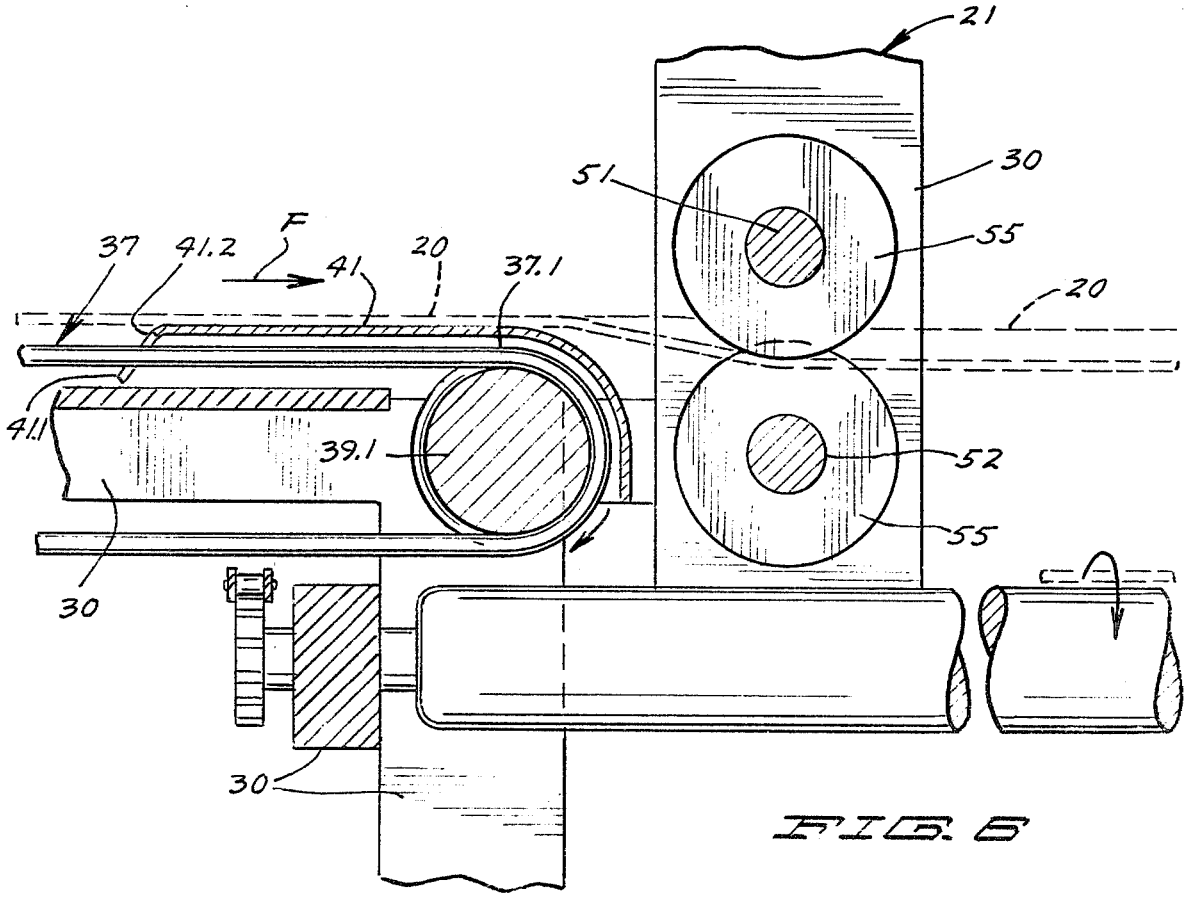
FIG. 6

BAG MAKING MACHINE

This invention relates to a machine for making bags from heat sealable film supplied in tube stock form.

BACKGROUND OF THE INVENTION

Although millions upon millions of polyethylene bags are used annually, such bags formed of film type plastic are made with rather antiquated techniques. Commonly, the film material used in making plastic bags is supplied in tubular form, known as tube stock, and stored in a large roll.

In all known forms of bag making, the bag material in tube stock is fed intermittently to a sealing and cut-off mechanism, and then the bags are stacked for subsequent handling. As the tube stock is supplied to the cutting and sealing station, the movement of the tube stock is controlled by pinch rollers through which the tube stock is propelled. The pinch rollers revolve to direct an adequate length of stock for the formation of a bag, and then the rollers stop monentarily to allow the necessary sealing and cut-off to be effected, after which the pinch rollers again start turning to supply an additional length of bag material for the next bag to be formed.

In some known machines, the tube stock is laid flat so that the bags are essentially horizontally oriented as they are cut off and sealed; and in other instances, as is disclosed in U.S. Pat. No. 3,192,096, the bag material is initially suspended adjacent the location of the cut-off, and then the bag material is carried by needles to a band sealer for sealing across the ends of the bags while the bags remain in vertical orientation, suspended between conveyor chains.

SUMMARY OF THE INVENTION

The present invention draws the tube stock from the supply roll and continuously propels the tube stock horizontally through the cut-off mechanism and through the sealer for sealing one end of the bag. An improved cut-off mechanism is provided to cut the tube stock on the fly without requiring the tube stock to stop or hesitate during the cutting process. During the cutting, the tube stock, in the vicinity of the cut, is tightly gripped on both sides of the cut and essentially stretched so as to allow the film to be cleanly cut at the exact desired location.

While the speed of the tube stock being supplied into the cutter mechanism is controlled by the continuously operating feeding rolls, the tube stock is drawn from the feed rolls and supplied horizontally into and through the cutter mechanisms by a high speed belt conveyor which has a lineal rate of travel, usually greater than, but at least as great as, the feed rate of the feed rolls.

After the cut lengths of tube stock, or tube segments, from which bags are made, are severed from the supply, the same belt conveyor also carries the tube segments away from the cutter mechanism, at a speed usually greater than, and never less than, the speed at which the tube stock is supplied to the cutter mechanism.

After the cutting has been completed, the tube segment for forming the bag continues to travel in a horizontal endwise direction. The tube segment suddenly changes direction by 90 degrees so as to travel in a second direction perpendicular to the first direction, but still horizontally, whereupon, as one of the folded sides of the flattened tube segment leads in the second direction, the cut end edge of the tube segment extends in the second direction and along the conveyor, and a high speed band sealer is used to rapidly seal across one cut end edge of the tube segment for actually forming the tube segment into a bag.

The change of direction of crossfeed is accomplished by the use of a multiplicity of feed rollers in closely spaced side by side relation onto which the tube segments are supplied and then held down by a plurality of spinning balls which cooperate with the rollers to pinch an edge of tube segment and rapidly propel it in the second direction.

As the tube segment is being supplied from the first belt conveyor and onto the crossfeed rollers, the flat tube segment must be propelled, as by pushing, so that it will slide across the full length of the crossfeed rollers until it is stopped by a fence and pinched between the crossfeed rollers and the superposed balls. In order to accommodate such propelling of the tube segment by pushing, the tube segment is crimped by spaced and rapidly spinning wheels so as to temporarily give the length of bag material a corrugated set with the corrugations extending in the direction of travel. The tube segment is thereby strengthened to minimize the likelihood of the length of bag material flying either upwardly or downwardly as it is propelled across the length of the crossfeed rolls. The folded edge, which is to be the leading edge of the tube segment after the direction change, is caused to assume an upwardly inclined set, as to prevent the edge from being inadvertently drawn downwardly between adjacent crossfeed rolls.

The crossfeed rollers vary in spacing and orientation. The crossfeed rollers which underlie the leading edge and adjacent portions of the tube segment which has been received from the crimping wheels, are in closely spaced relation to each other for maximum engagement with the tube segment being propelled and also to prevent the folded leading edge of the tube segment from inadvertently passing downwardly between a pair of adjacent crossfeed rollers.

Another group of crossfeed rollers underlying the tube segment as it is received from the crimping wheels, are in widely spaced relation to each other, and these widely spaced rollers are spaced each from each other, center to center, a distance approximately twice the center to center spacing of the first mentioned closely spaced rollers. These widely spaced rollers have the effect of allowing the crimped set of the tube segment to exist for a longer period of time as to contribute materially to the stiffness of the tube segment propelled from the crimping wheels and in a direction along the crossfeed rollers. Furthermore, these widely spaced crossfeed rollers will allow the trailing folded (or upstream) edge of the tube segment to hang down, momentarily, between an adjacent pair of the widely spaced crossfeed rollers; and this momentary hanging down of the folded side of the tube segment also contributes materially to the temporary stiffness of the bag in order to allow the bag to continue to slide longitudinally of the crossfeed rollers under the influence of the crimping wheels.

The corrugated set in the lengths of plastic immediately starts to dissipate as the length of bag material traverses the crossfeed rollers, but there is a sufficient memory in the film material as to retain sufficient amount of the set so that the tube segment will be guided by a vane and then directed between the spinning rollers and the superposed weighted balls until the cut end edge of the tube segment engages a guiding fence which essentially stops movement of the length of bag material in first direction as it is rapidly propelled in the second direction.

The guiding fence against which the edge of the tube segment engages as the tube segment is rapidly propelled across the crossfeed rollers, is in two different segments. The upstream (relative to the crossfeed conveyor) portion of the fence is stationary, adjacent the ends of the widely spaced crossfeed rollers. The second segment of the fence is a rapidly moving fence, moving at the same rate of speed as the crossfeed conveyor. The moving fence is located adjacent all of the closely spaced crossfeed rollers so as to engage the edge of the bag and contribute materially to the propulsion thereof along the crossfeed conveyor. The tube segments are continuously urged into engagement with the moving fence by the closely spaced crossfeed rollers. These rollers, while being oriented transversely of the direction of movement of the crossfeed conveyor, so as to propel the tube segments along the crossfeed conveyor, are not precisely perpendicular to the direction of travel of the crossfeed conveyor, but are oriented at a slightly oblique angle with respect to the direction of travel of the crossfeed conveyor. These closely spaced crossfeed rollers are oriented at an acute angle with respect to the moving fence so that the rapidly spinning closely spaced crossfeed rollers will continuously urge all portions of the tube segments slightly toward the moving fence as to assuredly align the full cut end edge of the tube segment along the moving fence.

From the crossfeed rollers and superposed weighted balls, the lengths of bag material are directed onto another belt conveyor which carries the length of bag material through the band sealer from which the bags are carried to a stacker. As the individual bags are stacked, they are again corrugated so as to be shot across the stack without flying off.

Two stacker conveyors are proposed so that alternate quantities of bags may first be accumulated adjacent one stacking conveyor and then adjacent the other.

BRIEF DESCRIPTION OF DRAWINGS

FIG. 2 is an enlarged detail section view of the tube stock feeding mechanism taken approximately at 2—2 in FIG. 1.

FIG. 3 is an enlarged detail section view taken approximately at 3—3 in FIG. 1 and showing the cutter mechanism.

FIG. 6 is an enlarged detail section view taken approximately at 6—6 in FIG. 1.

DETAILED SPECIFICATION

Figures 1, 10:
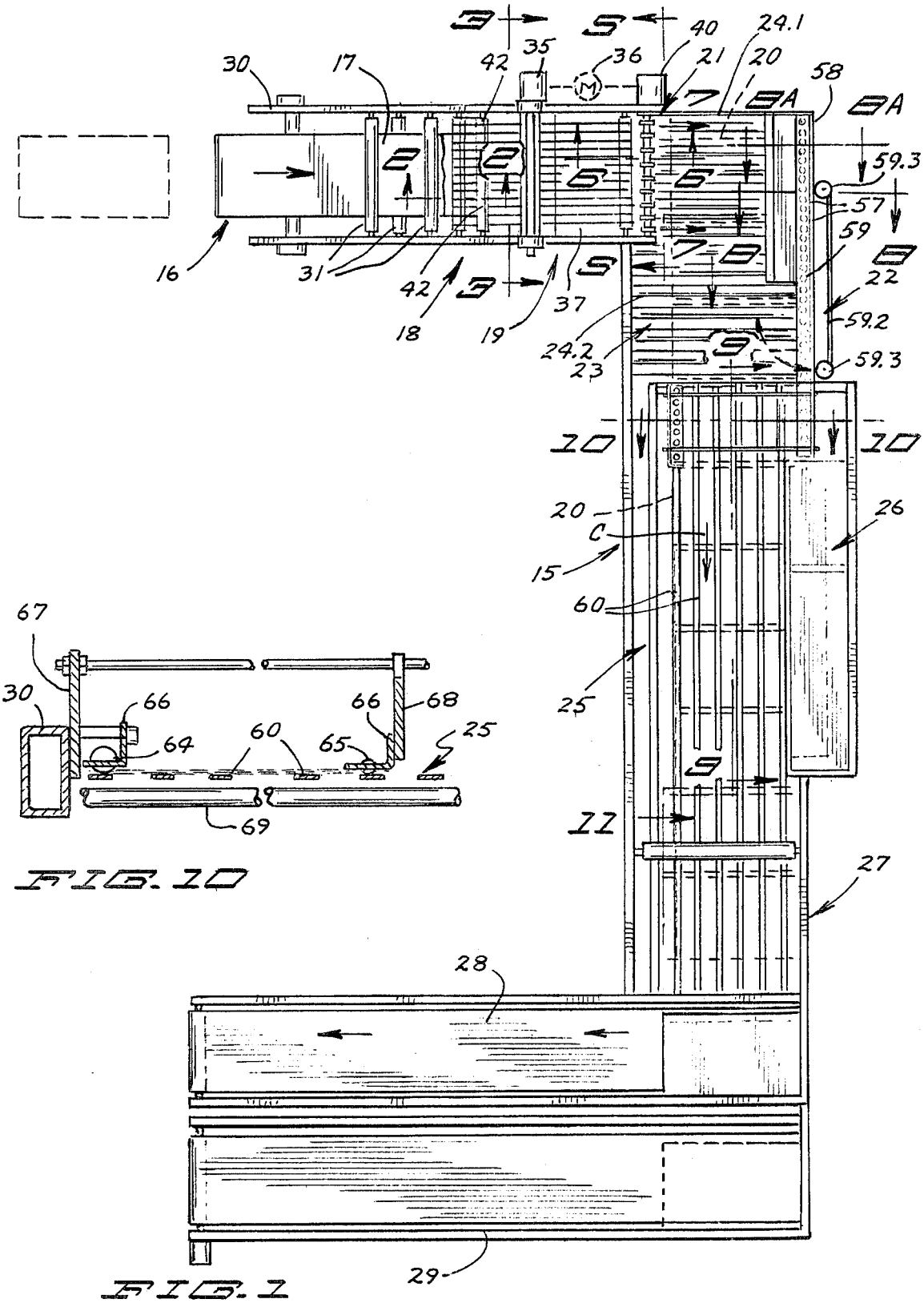
FIG. 1 is a top plan view of the bag making machine as a whole.
FIG. 10 is a detail section view taken approximately at 10—10 of FIG. 1.
Figure 9:
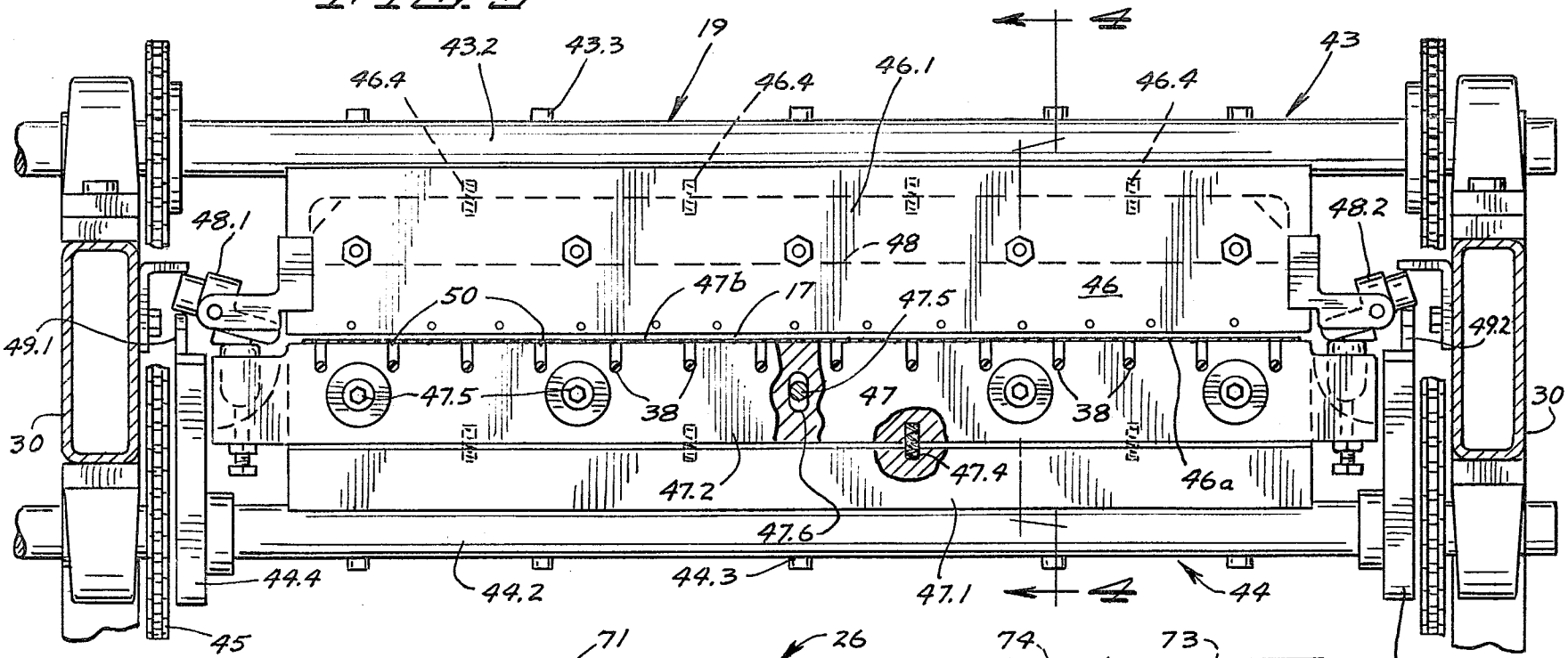
FIG. 9 is an enlarged detail section view taken approximately at 9—9 of FIG. 1 and having portions broken away for clarity of detail.
Figure 9:
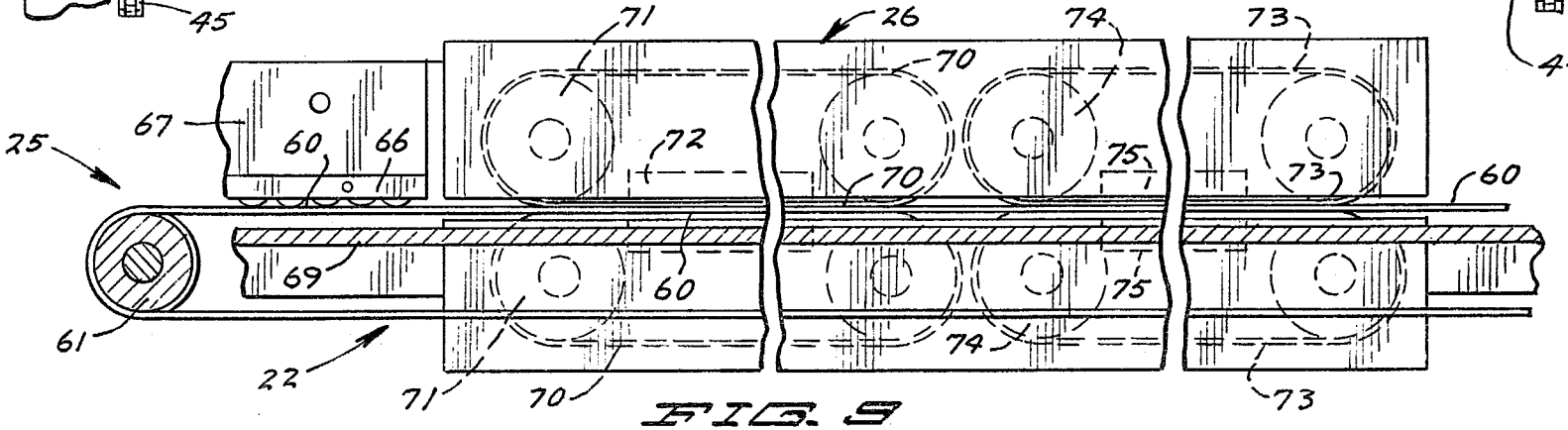

The bag making machine is illustrated in FIG. 1 and is indicated in general by numeral 15.

The machine 15 has several distinct sections. The film tube stock is supplied in a long continuous piece rolled into a supply roll 16. The film in the tube stock 17 is usually polyethylene and may vary in thickness from two mils to six or eight mils. Of course, other film materials may be used. An in-feed conveying mechanism 18 draws the tube stock from the supply and feeds the tube stock continuously at a rate of up to 2,000 inches per minute. The in-feed conveying mechanism includes feed rolls 42,42′ which control the speed of the film; and a belt conveyor 37 to support and propel the tube stock.

Along the in-feed conveyor mechanism 18 is a cutting mechanism 19 to sever tube segments 20 from the tube stock 17 while the tube stock and tube segments continue to move continuously with the in-feed conveying mechanism 18.

A crimping mechanism 21 longitudinally corrugates the tube segments 20 and cooperates with the in-feed conveyor mechanism 18 to propel and shoot the tube segments, with their temporary corrugated set, transversely across the receiving end of a crossfeed conveying mechanism 22. The crossfeed conveying mechanism has two separate sections, a roller conveyor 23 consisting in a multiplicity of driven spinning rollers 24; and a belt conveyor 25. The crossfeed conveyor mechanism 22 changes the direction of travel of the tube segments 20 without reorienting the tube segments and carries the tube segments at a high rate of speed into and through a high speed sealer 26 which seals across one of the cut end edges of each of the rapidly moving tube segments 20 for effectively converting the tube segments into open ended bags, each having one closed end.

The machine also has a stacking section 27, wherein the tube segments 20 are accumulated in stacks which are discharged by conveyors 28 and 29 for further handling.

The supply roll is rotatably carried on a spindle supported from the frame 30 of the machine. The length of tube stock 17 is threaded under and over a number of take-up rolls 31 as the tube stock 17 is drawn toward the in-feed conveying mechanism.

The in-feed conveying mechanism 18 includes the belt conveyor 37 having a plurality of individual endless conveyor belts 38 which are made from rubber tubing and have circular transverse configurations. There is a multiplicity of such belts 38 lying in side by side and spaced relation to each other, and trained around a pair of grooved pulleys 39 and 39.1 journaled in suitable bearings on frame 30. The multiplicity of belts 38 have parallel upper runs which support the tube stock 17 in horizontally laid out condition so that the tube stock 17 continues to travel endwise longitudinally between the grooved feed rolls 42 and 42′ as the tube stock progresses into the machine.

The belt conveyor 37 is driven by the motor 36 and through gear box 40 which may be a variable speed gear box so as to produce a desired relative speed in the conveyor 37 as compared to the in-feed speed of the tube stock 17 which is controlled by feed rolls 42, 42'. The belt conveyor 37 continuously draws the tube stock from the rolls 42, 42' and accordingly, the belt conveyor 37 travels at a speed usually greater than, but no less than, the speed of the tube stock.

At the delivery end 37.1 of the in-feed conveyor 37, a stationary guide plate 41 is rigid with the frame 30 and traverses the entire width of the conveyor 37 and overlies the grooved pulley 39.1. The guide plate or panel 41 has depending fingers 41.1 protruding obliquely downwardly between adjacent belts 38 which are received in slots 41.2 between the fingers 41.1 Accordingly, the plastic material, which, at this location, is in the form of individual tube segments 20, is guided by the panel 41 above the belts 38 and is directed into the crimping mechanism 21 which is immediately adjacent the delivery end of the belt conveyor 37.

The elongate driven feed rolls 42, 42' traverse the entire belt conveyor 37 and have annular grooves 42.1 on their peripheries in alignment with the belts 38 of the belt conveyor 37. The feed rolls 42, 42' tightly grip the tube stock 17 for drawing tube stock from the supply roll, and the grooves permit the belts 38 to travel between the rolls and at a speed greater than the speed of the rolls 42, 42'.

The cutter mechanism 19 is disposed intermediate the ends of the belt conveyor 37 and operates to sever the continuously moving tube stock 17 into individual tube segments 20. The cutter mechanism includes a pair of rotors 43 and 44, respectively disposed above and below the upper run of the belt conveyor 37. The rotors 43 and 44 have sprocket wheels 43.1 and 44.2 which are driven from the variable speed gear box or coupling 35 in order to very precisely control the rotary speed of the rotors 43 and 44 in relation to the lineal speed of the tube stock 17. In operating the rotors 43 and 44, it may be desirable in some instances to drive these rotors with an epicyclic gear mechanism for the purpose of varying the rotary speed of the rotors within each rotational cycle.

The upper rotor 43 has an upper clamping jaw 46, and the lower rotor 44 has a lower clamping jaw 47. Both of the jaws rotate about their respective rotation axes and are affixed as by mounting screws 43.3 and 44.3 to the corresponding shafts. The upper jaw 46 has a pair of elongate clamping bars or jaws 46.1 and 46.2 which are separated by a slot 46.3 in which an elongate cutting blade 48 is confined. The clamping bar 46.1 is stationary with the shaft 43.2 so as to revolve therewith. The other clamping bar 46.2 lies alongside bar 46.1 and along the whole length thereof and is resiliently movable in a direction substantially radially with respect to the axis of shaft 43.2. The yieldable bar 46.2 is continuously urged away from shaft 43.2 and away from the ledge portion 46.11 by a plurality of coil springs 46.4, spaced along the length of the jaw 46.

The yieldable clamping bar 46.2 is retained against the bar 46.1 by clamping bolts 46.5 which extend through vertically oriented slots 46.6 in the yieldable clamping bar 46.2. The slots accommodate edgewise movement of the bar 46.2 toward and away from the lower jaw 47 and the tube stock clamped therebetween.

The clamping bars of jaws 46.1 and 46.2 have jaw faces 46*a* and 46*b* which confront the tube stock 17 and the lower jaw 47.

A pair of elongate rubber jaw elements 49 are suitably clamped in slots all along the length of the clamping bars 46.1 and 46.2 for providing a slightly deformable and yieldable appendage for each of the jaw faces 46*a* and 46*b*.

The lower jaw 47 is constructed substantially the same as the upper jaw 46 and also has a pair of clamping bars or jaws 47.1 and 47.2 defining the clamping jaw faces 47*a* and 47*b*. The jaw faces have V-shaped grooves extending along the entire lengths thereof to receive the rubber elements 49 as to provide a very firm clamping of the plastic tube stock 17 between the jaws, and also as to stretch the short length of tube stock which confronts the edge of the blade 48.

The lower jaw 47 also has a blade-receiving slot 47.3 which receives the blade 48 as it protrudes at the instant of alignment of slots 46.3 and 47.3 during each rotational cycle of the rotors. It will be recognized that slot 47.3 is broad and has a downwardly diverging shape as to accommodate some limited swinging of the jaws 46 and 47 while the blade 48 protrudes into the slot 47.3.

The clamping bar 47.2 is yieldable in a direction generally radially of the rotation axis of shaft 44.2 and is spring pressed toward jaw 46 by a plurality of springs 47.4. The yieldable clamping bar or jaw 47.2 is retained by a plurality of clamping bolts 47.5 extending through elongate slots 47.6 in the yieldable bar.

A significant difference in the lower jaw 47 as compared to the upper jaw 46 is the fact that the lower jaw 47 has a multiplicity of vertically oriented open topped slots 50 through the upper clamping faces 47*a* and 47*b* of the clamping bars 47.1 and 47.2. The multiplicity of slots 50 are for the purpose of receiving the conveyor belts 38 therethrough so that the jaw faces 47*a* and 47*b* may swing upwardly between the belts 38 and to a level above the belts 38 for the purpose of clamping the tube stock 17 in cooperation with the jaw 46 while the knife blade 48 severs the tube stock.

As the rotor 44 revolves and carries the jaw 47 with it, in the direction of arrow A, and as the rotor 43 revolves the jaw 46 in a direction of arrow B, the lower jaw faces 47*a* and 47*b* progressively raise the tube stock 17 slightly off the belts 38 for clamping and cutting and then permit the tube stock and the severed tube segment to again lower onto the belt 38. The speed of rotation of rotors 43 and 44 is adjusted so that the lineal travel of the jaw faces substantially equals the lineal speed of the tube stock and in the same direction indicated by arrow F so that there is essentially no relative motion in a direction longitudinally along the tube stock between the tube stock and the faces of jaws 46 and 47 as the tube stock is clamped and cut.

It will be recognized in FIG. 3 that the jaws 46 and 47 extend entirely across the width of the belt conveyor which is similar in width to the width of the stock 17, and the blade 48 extends along the full length of the upper jaw 46. The blade 48 is controlled by a pair of cam linkages 48.1 and 48.2 on the upper jaw 46, and revolving cams 49.1 and 49.2 affixed to the end plates 44.4 of the lower rotor 44.

Figure 4:
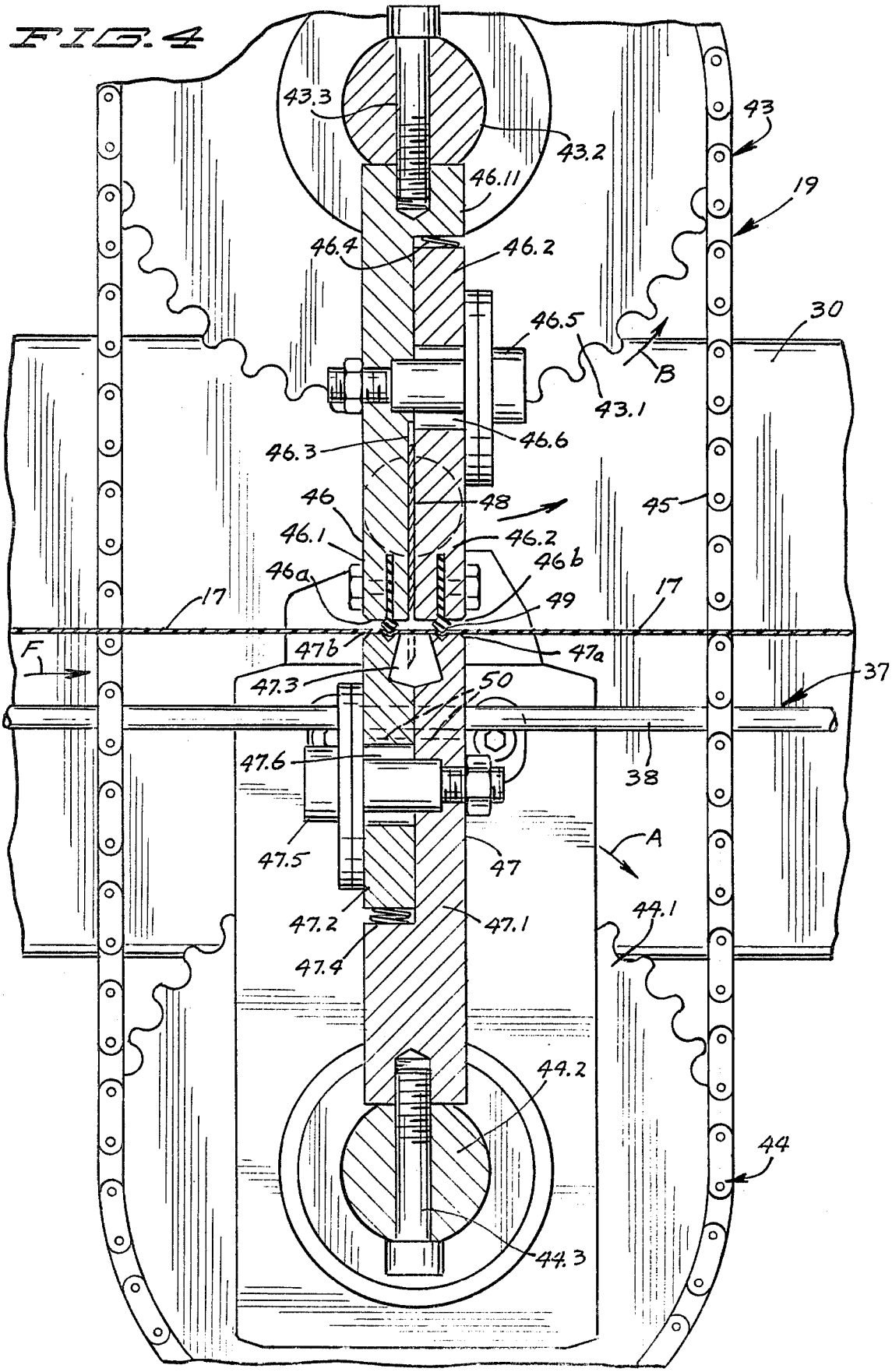
FIG. 4 is an enlarged detail section view taken approximately at 4—4 in FIG. 3.

As the jaws 46 and 47 revolve into substantial alignment with each other, as illustrated in FIG. 4, the revolving cams 49.1 and 49.2 engage the cam follower rollers of the linkages 48.1 and 48.2 to swing these linkages which cause the blade 48 to quickly move outwardly of the slot 46.3 and to protrude through the tube stock 17 into the slot 47.3 of the lower jaw 47. The cams 49.1 and 49.1 are shaped as to cause the opposite ends of the blade 48 to be moved outwardly of jaw 46 in slightly sequenced relation to each other rather than entirely simultaneously. The result is that the blade 48 will move with a rocking motion as to first sever the tube stock adjacent one of its folded side edges and then progressively cut the tube stock transversely across. Return springs swing the linkages 48.1, 48.2 back to the rest position illustrated to withdraw blade 48 out of the slot 47.3 in jaw 47 while the jaw faces of the upper and lower jaws are still in registration with each other.

It will be especially recognized that the two yieldable clamping bars or jaws 46.2 and 47.2 are located fore and aft with respect to each other and with respect to the slots 46.3 and 47.3 through which the blade passes. In this construction, each of the yieldable jaws or bars 46.2 and 47.2 is disposed across from a non-yielding clamping bar or jaw 47.1 and 46.1, respectively.

Accordingly, as the jaws 46 and 47 swing with the rotors in the direction B and A respectively, the clamping faces **46*b* and 47*a* will first engage the opposite faces of the tube stock 17. As the jaws 46 and 47 continue to rotate so that the lineal speed of the jaw faces is substantially equal to the lineal speed of the tube stock 17, the upper yieldable bar 46.2 will yield slightly against the pressure of spring 46.4 and the rubber element 49 will slightly press the tube stock into the V-shaped groove on the jaw face 47*a*. Subsequently, the jaw faces 46*a* and 47*b* will engage the opposite faces of the tube stock and the clamping bar 47.2 will yield slightly downwardly against the spring pressure of spring 47.4. As a result, the jaw faces 46*a* and 47*b* tightly clamp the tube stock and cause the tube stock to be deflected slightly into the V-shaped groove in jaw face 47*b*. As a result, the short length of tube stock 17 which spans the lower groove 47.3 is drawn taut so that the tube stock may be easily cut by a simple downward rolling movement of blade 48. Accordingly, no shearing edge is needed to cooperate with blade 48**, and the cutting is a simple slicing motion.

After the cutting is complete, the jaws 46 and 47 continue to swing in the directions of arrows B and A, and a portion of the tube stock downstream of the cutter mechanism is then free and comprises one of the tube segments 20. Clamping bar 47.2 yields slightly as the jaws swing and the jaw faces **46*a* and 47*b* continue to clamp and carry the tube stock 17** forwardly without hesitation.

Because the belt conveyor 37 is usually travelling faster than the lineal speed of the tube stock 17, the tube segments 20 that are severed from the tube stock 17 are immediately drawn endwise away from the cut edge of the tube stock in order to provide some spacing between the tube stock and the tube segment and between the adjacent tube segments travelling along the several conveyors.

Figure 5:
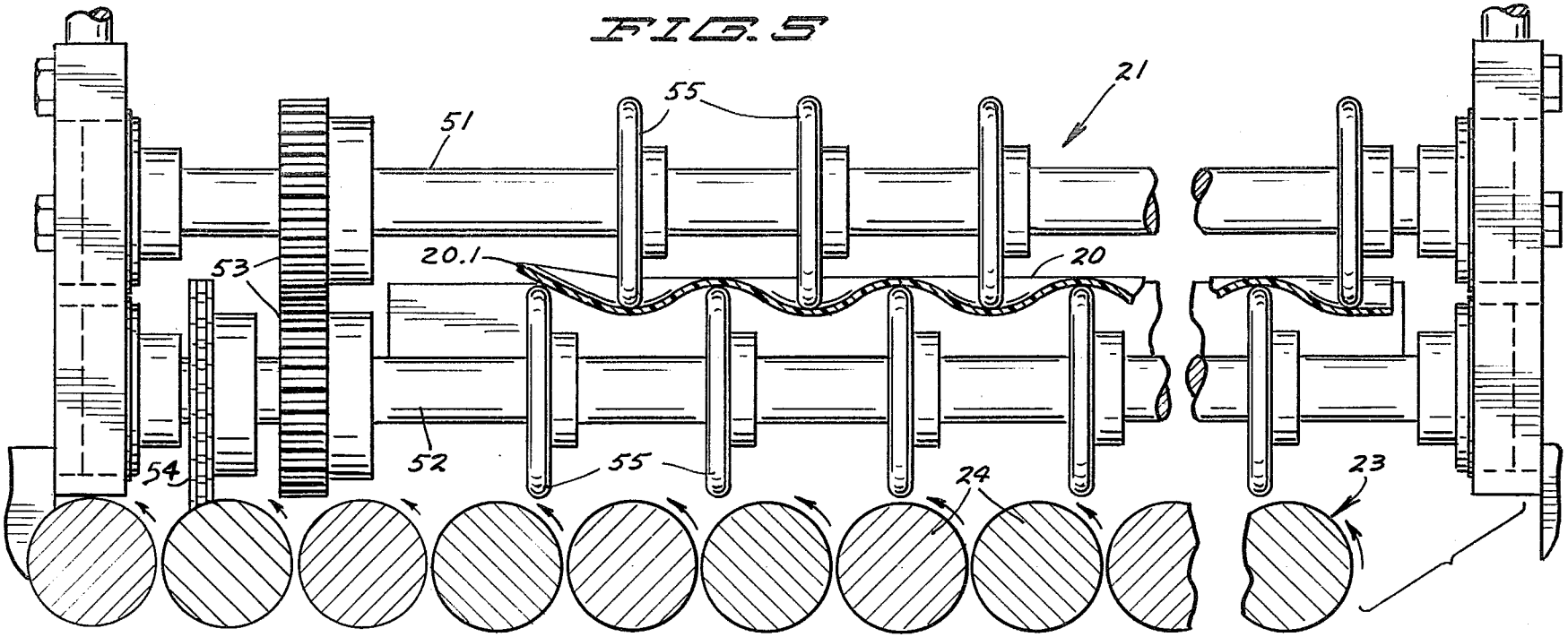
FIG. 5 is an enlarged detail section view with portions thereof broken away and taken approximately at 5—5 in FIG. 1.

The crimping mechanism 21 is illustrated in FIGS. 5 and 6 and includes a pair of spaced and superposed shafts 51 and 52 carried in suitable bearings on the frame and having meshed sprockets 53 causing the shafts 51 and 52 to turn at the same speed. The lower shaft 52 has a chain and sprocket 54 driven from the gear box 40 in coordinated relation with the belt conveyor 37 for propelling the tube segments 20 at substantially the same speed as propelled by belt conveyor 37.

The crimping mechanism 21 also has a plurality of crimping wheels 55 affixed to and spaced from each other along the two shafts 51 and 52, and as clearly seen in FIG. 5, the wheels are in slightly lapped and interleaving relation with each other to produce a corrugated set in the tube segment as the tube segment travels between the wheels of the upper and lower shafts. The corrugated set illustrated in FIG. 5 is temporary, but will last sufficiently long relative to the high speed of motion of the tube segments 20 as to stiffen the tube segments and allow the tube segments to be propelled, actually by pushing, transversely across the receiving end of the crossfeed conveying mechanism 22. The corrugated shape holds the tube segments sufficiently stiff as they are shot from the crimping wheels 55 as to cause the leading edge of each tube segment to engage the lower side of a stationary vane 56 for guiding the leading edge of the tube segment downwardly onto the spinning rollers 24 at the receiving end of the crossfeed conveyor mechanism 22.

Figure 8A:
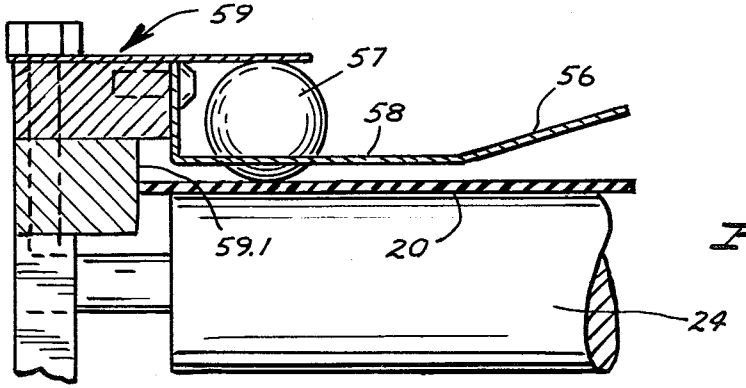
FIG. 8A is an enlarged detail section view taken approximately at 8A—8A in FIG. 1.
Figure 8:
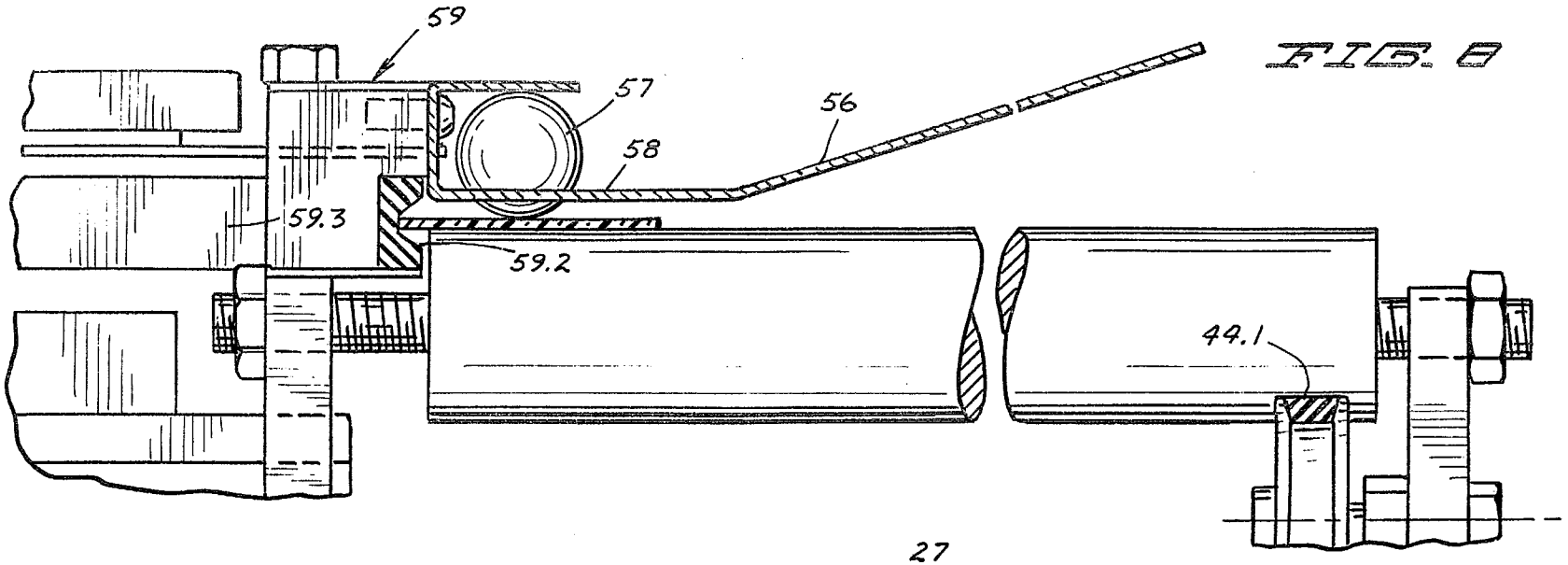
FIG. 8 is an enlarged detail section view taken approximately at 8—8 in FIG. 1.

The individual rollers 24 in the roller conveyor are in side by side relation at a location slightly below the crimping wheels 55. The rollers 24 are journaled in suitable bearings on the frame 30 and are all driven in the same direction from the gear box 44 as by a friction drive belt 44.1 (see FIG. 8) and at a speed coordinated with the speed of the belt conveyor 37. In most instances, the roller conveyor 23 will be operated at a speed proportionately less than the speed of the belt conveyor 37 and in a proportion similar to the proportion of the width of the tube segments 20 to the length of the tube segments. Accordingly, the tube segments passing along the crossfeed conveyor mechanism 22 will be spaced from each other approximately the same distance as is the distance between adjacent tube segments travelling from the belt conveyor 37.

Vane 56 is secured to the frame at the side of the roller conveyor opposite the delivery end of the belt conveyor 17.

The roller conveyor 23 also has a plurality of spinning balls 57 aligned along the ends of rollers 24 and held stationary in a keeper portion 58 of vane 56 which has a plurality of retaining openings 58.1 each confining a respective ball 57 therein. Each ball 57 is disposed above and bears downwardly upon a respective roller 24. The keeper 58 is spaced up off the roller 24 so that the vane 56 will guide the leading end cut edge of the tube segment 20 beneath the balls 57 as the tube segment 20 is flung or shot across the receiving end of the roller conveyor 23 from the crimping wheels 55. Balls of different weights will be selected and used for various weights, thicknesses and types of plastic film in the tube stock 17. The balls may be steel, glass, or light weight plastic, according to the desired weight.

Figure 7:
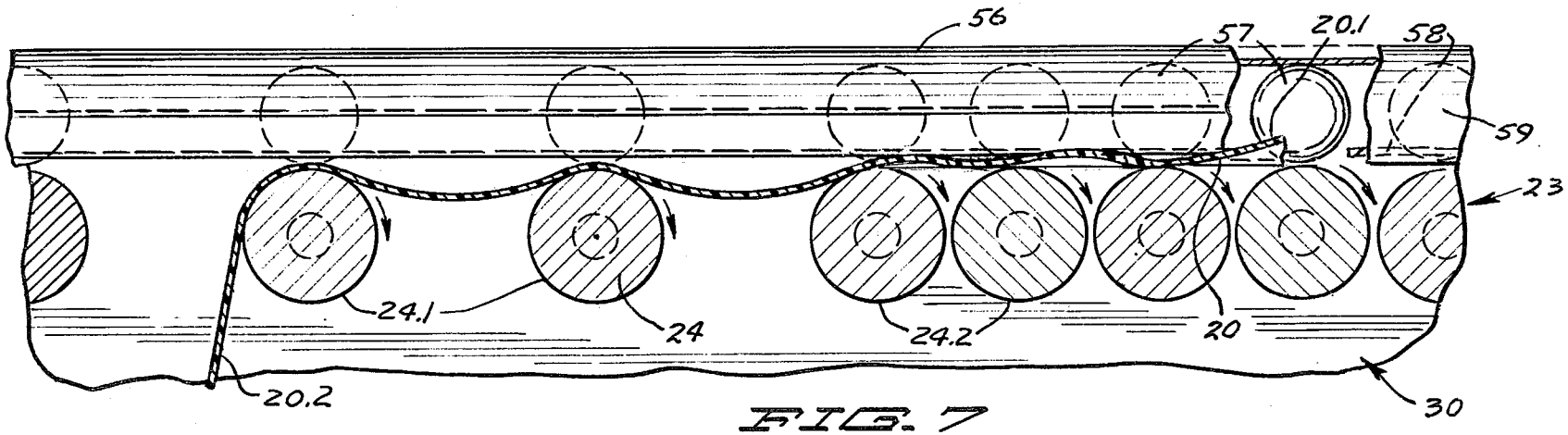
FIG. 7 is a detail section view taken approximately at 7—7 in FIG. 1.

It will be recognized that not all of the crossfeed rollers 24 are equally spaced from each other, nor are they oriented exactly the same. There are two separate groups of crossfeed rollers, 24.1 and 24.2. Rollers 24.2 are spaced closely together so that only a very minimum of open space exists between adjacent rollers. Accordingly, these closely spaced rollers 24.2 essentially prevent the possibility of any tube segment 24 from passing downwardly between two adjacent crossfeed rollers 24.2. A number of these closely spaced rollers 24.2 are in substantial alignment with the right-hand side of the in-feed conveyor 37 so as to underlie one side portion of each of the tube segments 20 propelled onto the crossfeed rollers by the crimping wheels 55; and the leading edge of each of the tube segments 20, in relation to the direction of travel indicated by arrow C in FIG. 1 along the crossfeed conveyor, will overlie one or another of the closely spaced rollers 24.2. As illustrated in FIG. 7, the leading edge 20.1 will be elevated slightly, due to the corrugated crimp set produced by the crimping wheels 55. The crimp set of the tube segment, together with the closely spaced relation of the crossfeed rollers 24.2 combine to contribute materially to prevent any possibility of the tube segment passing downwardly between the crossfeed rollers.

The second group of widely spaced crossfeed rollers 24.1, are spaced from each other very significantly further than are the closely spaced rollers 24.2, and the widely spaced crossfeed rollers 24.1 are spaced substantially twice as far, center to center, as are the rollers 24.2. These widely spaced rollers 24.1 are in substantial alignment with the lefthand side of the in-feed conveyor 37. Because of the widely spaced relation between the rollers 24.1 which will underlie the trailing (relative to the direction C of the travel of the crossfeed conveyor) side portion of each of the tube segments 20, the tube segments will be allowed to sag between the adjacent widely spaced rollers 24.1 and retain, to a greater degree, the preset crimp originally produced by the crimping wheels 55. Further, the widely spaced relationship between rollers 24.1 allows the trailing edge portion 20.2 of each tube segment to hang down into the unobstructed space between adjacent widely spaced rollers 24.1. The hanging downwardly of the trailing edge portion 20.2 of the tube segment 20, together with the greater sag and retained crimp set in the bag between the widely spaced rollers 24.1, both contribute materially to the stiffness of the tube segment 20 as it is rapidly propelled from the crimping wheels 55 and longitudinally of the underlying crossfeed rollers 24 so as to prevent any possible flying or misdirection of the tube segment.

Figure 7A:
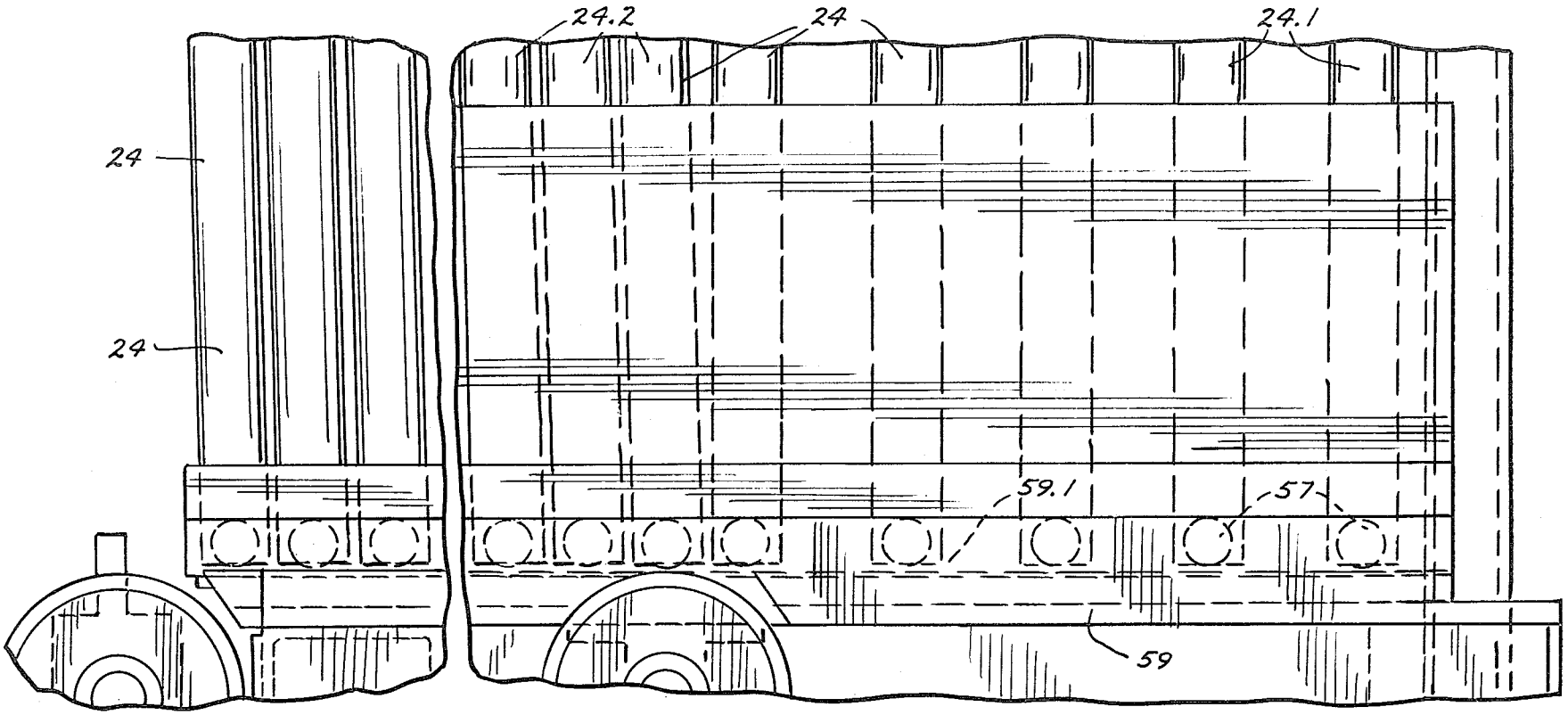
FIG. 7A is an enlarged detail top plan view of the upstream portion of the crossfeed conveyor.

In FIGS. 1 and 7A, it will also be recognized that the closely spaced crossfeed rollers 24.2 are oriented at a slightly oblique angle, rather than entirely perpendicular, relative to the forward direction of travel C of the crossfeed conveyor. The axes of rollers 24.2 are approximately 2.5 degrees off normal so that the angle Theta ($\theta$), seen in FIG. 1, between the rotation axes of the rollers 24.2 and the longitudinal side edge of the crossfeed conveyor 23 will be approximately 87.5 degrees.

An elongate fence structure, indicated in general by numeral 59, extends longitudinally along and above rollers 24 adjacent the spinning balls 57 and the bag-guiding vane 56. The fence structure 59 is mounted on the frame 30 and has two distinct significant sections, a stationary bar 59.1 and a longitudinally moving fence 59.2 which takes the form of an endless rubber belt extending along the ends of the closely spaced crossfeed rollers 24.2, and trained about pulleys 59.3. The downstream pulley 59.3 is driven by a line shaft powered from gear box 40 and at a speed as to drive the moving fence 59.2 at a rate substantially identical with the speed of travel of the crossfeed conveyor mechanism 23. It will be recognized that the tube segments 20 are stopped by the fence structure 59 as they slide across the crossfeed rollers and under the balls 57. Because the closely spaced crossfeed rollers 24.2 are slightly obliquely oriented, these crossfeed rollers 24.2 will continuously urge the tube segments 20 toward the travelling fence 59.2 so as to assure that the tube segment is properly aligned with the full length of the cut end edge of the tube segment bearing against the moving fence 59.2, thereby assuring that the tube segment will be properly oriented as it enters the high speed band sealer 26.

The motion of the tube segments in the direction of arrow F generated by belt conveyor 37 causes the cut end edge of each tube segment to be propelled beneath the row of balls 57 and against fence 59. The combined effect of the spinning rollers 24 and the spinning balls 57 cause the tube segments to instantly accelerate and commence their travel along the crossfeed conveyor mechanism 22 without reorienting the tube segments.

It has been observed that, although the tube segments are spaced apart as they come from the belt conveyor 37, there is an actual overlapping of tube segments adjacent each other as the tube segments undergo the change of direction and start along the crossfeed conveyor mechanism. The tube segments will actually space themselves from each other by approximately two inches as they travel along the crossfeed conveyor mechanism 22.

Figure 11:
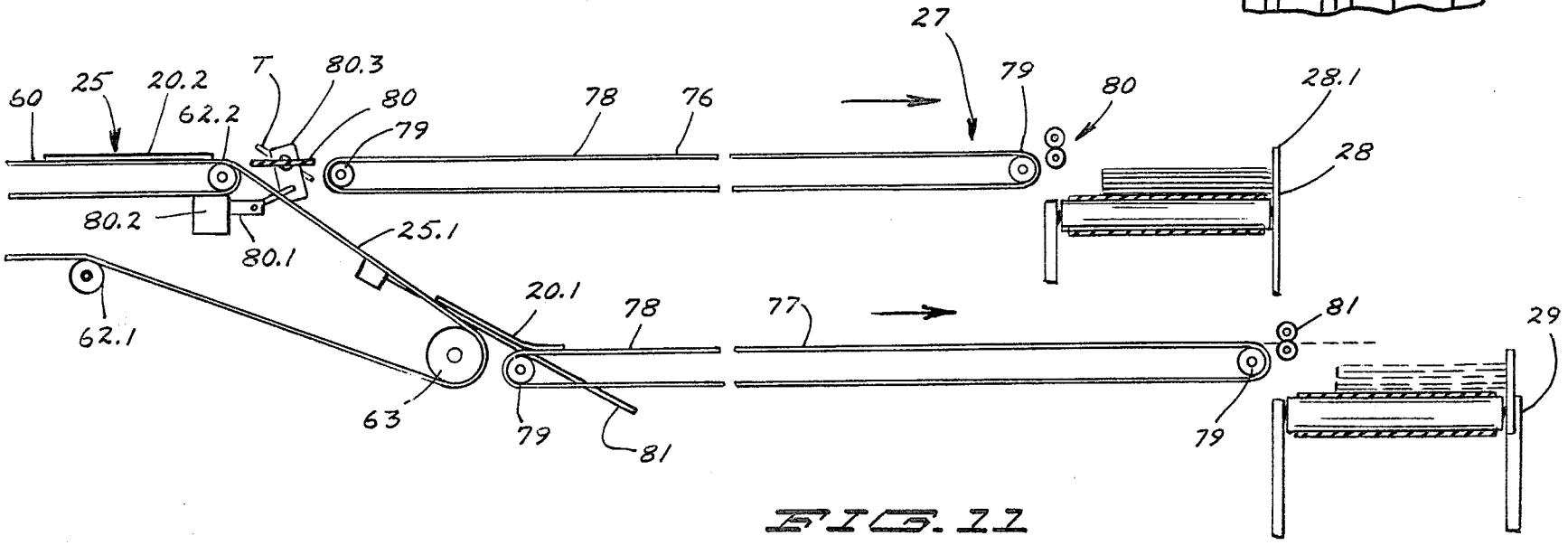
FIG. 11 is a detail section view, somewhat diagrammatic, and taken approximately at 11—11 of FIG. 1.

The belt conveyor 25 of the crossfeed conveyor mechanism 22 has a plurality of web belts 60 of fabric-like material or fiber glass, and having a strap-like configuration. These endless web belts 60 are trained about a rotating pulley 61 at the receiving end of belt conveyor 25, over idler pulleys 62.1 and 62.2 as seen in FIG. 11, and are trained about a driven pulley 63 which is driven off a line shaft connected with the gear box 40 in coordinated relation with the roller conveyor 23 as to propel the tube segments 20 at a uniform speed along the crossfeed conveyor mechanism 22. At the receiving end of the belt conveyor 25, a row of weighted balls 64 are arranged in a line in superposed relation with one of the web belts at one side edge of the belt conveyor 25 adjacent the fence 59, and another row of weighted balls 65 are also arranged in a line in superposed relation with another of the web belts of the conveyor. These balls 64 and 65 are retained in brackets 66 which are mounted on suitable supporting brackets 67 and 68 in stationary relation to the frame 30. These weighted balls allow the tube segments to pass beneath and assist in maintaining the exact desired orientation of the tube segments as the tube segments move toward and into the high speed sealer 26.

A rigid stationary panel 69 underlies the conveyor belt 60 along substantially the entire length of the belt conveyor 25.

The high speed sealer 26 is located along one side of the belt conveyor 25 and seals the ends of the tube segments travelling along the corresponding side of the belt conveyor. The high speed sealer 26 is of the type illustrated in U.S. Pat. No. 4,080,241, and accordingly is not here shown in considerable detail. It is sufficient to note that the sealer 26 has a pair of heating bands 70 above and below the level of the upper run of belt conveyor 25 for sealing the multiple laminae of the tube segments together. The bands are mounted on wheels 71 and are supplied with sealing heat by heating elements 72. Cooling bands 73 are arranged in tandem relation to the heating bands 70 for setting the welds formed in the tube segments by the time the ends of the tube segments emerge from the downstream ends of the sealer. The cooling bands 73 are mounted on wheels 74 and are cooled by cooling bars 75.

The high speed sealer causes the bands 70 and 73 to travel at the same identical speed as the belt conveyor 25 so that the tube segments will continue to run along the belt conveyor 25 without being misaligned or reoriented.

The stacking section 27 of the bag machine includes a pair of superposed delivery conveyors 76 and 77, both of which are belt conveyors substantially identical to the belt conveyor 25 and having a plurality of narrow web belts 78 spaced from each other in each of the conveyors 76 and 77 and trained around end pulleys 79. The upper run of conveyor 76 is in the same horizontal plane with the upper run of belt conveyor 25. A control gate or tiltable vane 80 spans the gap between the belt conveyor 25 and the receiving end of conveyor 76. The gate 80 is oscillatable about a horizontal axis so that the gate may tilt into the dotted line position T seen in FIG. 7 for the purpose of diverting, when tilted, the tube segments 20 downwardly along the inclined run 25.1 of the belt conveyor 25. The tilting of gate or guide vane 80 is controlled by the shifting armature 80.1 of a solenoid 80.2 which is connected to the control arm 80.3 on the end of gate 80. Shifting the solenoid between its two positions causes the gate 80 to swing between the full line position and the dotted line position illustrated in FIG. 11.

A plurality of guide fingers 81 are interleaved between the narrow conveyor belts 60 and 78 of the belt conveyors 25 and 77 to direct the tube segments from the inclined run 25.1 of the belt conveyor and onto the upper run of conveyor 77.

A pair of wide belt conveyors 28 and 29 accumulate stacks of the formed bags as they are discharged from the superposed conveyors 76 and 77. The upper run of each of the accumulating conveyors 28 and 29 are disposed considerably below the upper runs of the adjacent conveyors 76 and 77 so that the bags 20.1 can be propelled off the delivery ends of the conveyors 76 and 77 against the adjacent fence 28.1, 29.1 whereupon the bags will form a stack on the conveyors 28, 29. A pair of crimping devices 80 and 81 are disposed at the delivery end of the conveyors 76 and 77 for the purpose of producing corrugations in the bags 20.1 so that the bags will be sufficiently stiff as to be propelled transversely across the conveyors 28 and 29 to impinge against the fence and then settle into the stack on the conveyors. The crimpers 80 and 81 are substantially identical to the crimpers mechanisms 21 at the delivery end of belt conveyor 37 and have superposed shafts, with spaced wheels in overlapping and interleaving relation with each other for shaping the bags into corrugated sets.

It will be seen that this invention produces bags from a continuously moving supply of tube stock by cutting the tube stock without interfering with the continuing movement of the tube stock and then changing the direction of the cut tube segments so that they may pass through the high speed sealer for sealing across one end of each of the segments, thereby forming a bag.

What is claimed is:

1. A machine for severing and manipulating tube segments from a continuous supply of film tube stock, comprising a pair of continuously operating feed rolls on horizontal axes and adjoining each other to clamp, draw and feed the tube stock from the supply, a horizontal belt conveyor adjacent said feed rolls to receive and carry the tube stock in horizontally laid out condition from the feed rolls and traveling at a speed no less than the speed of said feed rolls, the conveyor having tube stock support means at a multiplicity of locations across the width of the belt conveyor, a cyclically operating cutting means located along and intermediate the ends of said belt conveyor and traversing a substantial portion of the width of the belt conveyor, the cutting means at once cutting transversely across the entire width of the tube stock to cut off tube segments while allowing the tube stock and tube segments to continue to travel along the belt conveyor at the speed of the belt conveyor, and a crossfeed conveyor adjacent the delivery end of the belt and conveyor and receiving the tube segments therefrom.

2. The tube stock and segments manipulating machine according to claim 1 and the horizontal belt conveyor traveling at a speed in excess of the speed of the feed rolls, the cutting means including a cooperating anvil and blade swinging along the belt conveyor at opposite sides thereof and of the tube stock and through an arc at a speed substantially the same as the speed of the feed rolls and the tube stock controlled thereby, the belt conveyor accelerating and moving the tube segments severed from the tube stock as the segments approach the crossfeed conveyor.

3. The tube segment manipulating machine according to claim 2 and the crossfeed conveyor having a plurality of closely spaced side by side and parallel conveying rollers at the receiving end thereof and changing the direction of travel of the tube segments without reorienting the tube segments.

4. In apparatus for cyclically severing tube segments from a continuously moving supply of film tube stock, comprising a continuously operating conveying means including a horizontal belt conveyor carrying the tube stock in horizontally laid out condition, the belt conveyor having a plurality of parallel and side by side individual tubing shaped belts spaced from each other and oriented to support and carry the flattened tube stock in horizontally laid out condition, and tube stock cutting means intermediate the ends of the belt conveyor and including an elongate anvil and an elongate cutter bar both extending transversely across the belt conveyor, the cutter bar being disposed above the belt conveyor and being movable downwardly to sever the tube stock, the anvil being disposed below the belt conveyor and having an upper edge portion with a plurality of transverse slots therein, each disposed adjacent a respective belt and receiving the belt therein, the anvil being movable upwardly to cause the upper edge of the anvil to pass upwardly through the spaces between the individual belts which are received in the slots, the anvil lifting the tube stock off the belt conveyor and cooperating with the cutter bar in severing the tube stock while the tube stock continues to travel along the belt conveyor.

5. The invention according to claim 4 and the anvil having an elongate longitudinally extending slot therein into which the cutter bar may be extended to sever the tube stock, and a pair of clamping jaw faces adjoining the cutter bar and movable downwardly in coordinated relation with the upward movement of the anvil to clamp the tube stock on both sides of the cutter bar during cutting of the tube stock.

6. In apparatus handling plastic film which is continually moving forwardly along a predetermined course, a pair of elongate revolving upper and lower web-shaped clamping jaws receiving the plastic film therebetween and rotating about parallel axes extending transversely of said forward direction and coordinated with each other to swing into and out of confronting relation to each other to bear against each other and simultaneously clamp the plastic film therebetween and thereafter release the film and to swing in said forward direction at the speed of travel of the plastic film, each of the elongate upper and lower jaws traversing the entire width of the plastic film traveling therebetween, each of the upper and lower jaws having a blade slot located intermediate the thickness thereof and extending longitudinally along the jaw to momentarily align with the slot in the other jaw at the moment of clamping of the film therebetween, and each of the upper and lower jaws having a pair of elongate bar shaped means adjoining the slot and respectively defining fore and aft jaw faces respectively disposed in front of and behind the blade slot relative to said forward direction, one force jaw face and one aft face of the revolving upper and lower jaws being independently resiliently yieldable radially toward the respective jaw axis to accommodate clamping of the film through a limited arc of travel of the revolving jaws, and a cutting blade in the blade slot of one of the jaws and being slidable therein, and means to move the blade beyond the jaw faces and into the slot of the other jaw to sever the film while the jaws are rotating through the limited arc of travel and while the film is clamped by the faces and in traversing relation to the slots.

7. The invention according to claim 6 and said one fore jaw face and said one aft jaw face being respectively disposed on separate upper and lower jaws to sequentially yield as the upper and lower jaws revolve through the limited arc of travel to complete clamping and release of the plastic film.

8. The invention according to claim 6 wherein each of the upper and lower jaws has a pair of elongate clamping bars disposed on opposite sides of the adjoining slot and each defining one of said fore and aft jaw faces, one of the bars of each of the jaws being yieldable all along its length and toward the rotation axis and spring pressed away from the rotation axis, and the other of the bars on each of the jaws being substantially stationary against radial movement relative to the rotation axis, one of the yieldable bars being disposed in front of, and the other of the yieldable bars being disposed behind the adjoining blade slot, the yieldable jaw face of each of the jaws cooperating with the stationary jaw face of the other jaw in clamping the film therebetween.

9. The invention according to claim 6 and the slot in the jaw opposite the blade and into which the blade protrudes being substantially wider than the thickness of the blade to maintain the adjoining jaw faces in spaced relation with the blade during the severing of the film.

10. A continuously operating machine for making plastic bags from tube segments cut from film tube stock, comprising elongate continuously operating in-feed conveying means carrying the flattened tube stock in horizontally laid out condition and longitudinally endways in a first direction, a cyclically operating cutting means located along the in-feed conveying means and cutting transversely across the tube stock to cut off tube segments while allowing the tube stock and tube segments to continuously travel along the in-feed conveying means, a crossfeed conveyor adjacent the delivery end of the in-feed conveying means and traveling in a second direction transverse to the first direction of travel of the in-feed conveying means, the receiving end of the crossfeed conveyor having a first side adjoining the delivery end of the in-feed conveying means and over which the tube segments pass onto the crossfeed conveyor, the crossfeed conveyor changing the direction of travel of the tube segments without reorienting or turning the tube segments, a high speed sealing means at one side of the crossfeed conveyor and closing and sealing across the cut ends of the tube segments traveling along the second conveyor, and crimping means adjacent the delivery end of the in-feed conveying means and including a multiplicity of crimping rollers traversing the delivery end of the in-feed conveying means and simultaneously propelling the tube segments transversely across the receiving end of the crossfeed conveyor and also crimping the tube segments and producing a corrugated set in the tube segments with the corrugations extending endways of the tube segments and longitudinally of the direction of travel of the in-feed conveying means to facilitate shooting the tube segments transversely across the receiving end of the crossfeed conveyor.

11. The bag machine according to claim 10 and the in-feed conveying means having a delivery end disposed significantly above the receiving end of the crossfeed conveyor, said crimping rollers being mounted on revolving shafts one above the other and respectively above and below the delivery end of the in-fed conveying means, the crimping rollers being disposed in widely spaced, but interleaving relation to each other to crimp and propel the tube segments passing therebetween.

12. The bag machine according to claim 10 wherein the crossfeed conveyor carries the tube segments with the folded edges thereof being the leading edges, the receiving end of the crossfeed conveyor including a plurality of closely spaced side by side and parallel conveying rolles onto which the tube segments are propelled from the crimping rollers whereby to change the direction of the tube segments to said second direction.

13. A machine for severing and manipulating tube segments from a continuous supply of film tube stock, comprising first and second horizontal conveyors continuously carrying the tube stock and tube segments in horizontally laid out condition sequentially in first and second directions transversely of each other, cutting means adjacent the first conveyor and severing the tube stock transversely thereacross to form tube segments while the tube stock continues to move longitudinally and in said first direction with said first conveyor, the tube segments with cut ends being delivered endways by the first conveyor to the second conveyor which changes the direction of travel to the tube segments without reorienting the tube segments and then carries the tube segments sideways in a second direction, and the second conveyor having a receiving end including a plurality of side by side revolving rollers propelling the tube segments in said second direction, and a first group of said rollers at the upstream end of the second conveyor being widely spaced from each other succicient to allow the tube segments propelled by the first conveyor onto the rollers to sag in the open spaces between the rollers.

14. The machine according to claim 13 and said rollers in the first group of rollers being spaced from each other by a distance on the order of the diameter of the rollers.

15. The machine according to claim 13 and there being a second group of rollers downstream of said first group and spaced closely together, the rollers in said second group of rollers being spaced significantly less than the rollers in said first group of rollers, adjoining rollers in said second group of rollers rotating in the same direction and influencing tube segments to continue over the top of all of the rollers.

16. A continuously operating machine for making plastic bags from tube segments cut from film tube stock, comprising first and second horizontal conveyors continuously carrying the tube stock and tube segments in horizontally laid out condition sequentially in first and second directions transversely of each other, cutting means adjacent the first conveyor and severing the tube stock transversely thereacross to form tube segments while the tube stock continues to move longitudinally and in said first direction with said first conveyor, the tube segments with cut ends being delivered endways by the first conveyor to the second conveyor which changes the direction of travel of the tube segments without reorienting the tube segments and then carries the tube segments sideways in a second direction, a high speed sealing means at one side of the second conveyor and closing and sealing across the cut ends of each of the tube segments traveling along the second conveyor, and the second conveyor having a receiving end including a plurality of side by side revolving rollers propelling the tube segments in said second direction, and said second conveyor also including a plurality of side by side flat belts spaced from said rollers in said second direction and extending along the high speed sealing means to carry the tube segments along the sealing means, and a plurality of spinning balls on certain of the belts to overlie the tube segments carried by the belts and including stationary retainers to hold said balls stationary while permitting rapid spinning thereof.

17. The machine according to claim 16 and a fence structure at said side of the second conveyor and adjacent the ends of the rollers to limit movement of the tube segments transversely across the second conveyor and guide the tube segments toward the sealing means, the fence structure including an upright moving fence travelling in the same direction as the second conveyor and engaging edges of the tube segment for guiding and propellin the tube segments.

* * * * *